US005219298A

United States Patent [19]

Morin et al.

[11] Patent Number: 5,219,298

[45] Date of Patent: Jun. 15, 1993

[54] ASSEMBLY FOR FORMING AN ELECTRIC CONNECTION THROUGH A PIPE FORMED OF SEVERAL ELEMENTS

[75] Inventors: Pierre Morin, Levallois Perret; Alain Sonnet, Rueil Malmaison, both of France

[73] Assignee: Institut Francais du Petrole, Rufil Maimaison, France

[21] Appl. No.: 863,767

[22] Filed: Apr. 6, 1992

Related U.S. Application Data

[63] Continuation of Ser. No. 636,273, Dec. 31, 1990, abandoned.

[30] Foreign Application Priority Data

Dec. 29, 1989 [FR] France ..... 89 17480

[51] Int. Cl.[5] ..... H01R 4/60

[52] U.S. Cl. ..... 439/192; 439/273; 439/736

[58] Field of Search ..... 439/190-195, 439/271-273, 276, 736; 166/65.1

[56] References Cited

U.S. PATENT DOCUMENTS 4,346,478 8/1982 Gale ..... 339/15
4,516,821 5/1985 Nieman ..... 329/75 M
4,557,538 12/1985 Chevalier ..... 339/16 C
4,806,115 2/1989 Chevalier et al. ..... 439/194
4,936,791 6/1990 Zielinski et al. ..... 439/271

*Primary Examiner*—Larry I. Schwartz
*Assistant Examiner*—Hien D. Vu
*Attorney, Agent, or Firm*—Antonelli, Terry, Stout & Kraus

[57] ABSTRACT

Assembly for forming at least one electric connection through a pipe formed of elements fixed together, each element having a first end and a second end, adapted to cooperate mechanically with the complementary ends of the adjacent elements. The assembly comprising in combination for each pipe element a conductor placed inside the element, a first connector fixed to the first end of the pipe element and which cooperates electrically with the conductor, a second connector fixed to the second end of the pipe element and which cooperates electrically with the conductor. At least one of the connectors comprises an anchorage piece and a removable connector. The anchorage piece comprises a housing for receiving a charge of uncured gum of stabilizable material for fixing the anchorage piece on the pipe element after curing or stabilization, and the assembly comprises an arrangement for locking the removable connector on the anchorage piece.

16 Claims, 5 Drawing Sheets

ASSEMBLY FOR FORMING AN ELECTRIC CONNECTION THROUGH A PIPE FORMED OF SEVERAL ELEMENTS

This is a continuation of application Ser. No. 636,273 filed Dec. 31, 1990 now abandoned.

BACKGROUND OF THE INVENTION

1. Field of the Invention

The present invention relates to an assembly for forming at least one electric connection between two points through a pipe, such as an electric connection which may serve, among other things, for supplying certain apparatus from an electric source, or for transmitting coded data in the form of electric signals.

This assembly may be used, for example, in a drill string. It may then transmit certain electrically coded data from the bottom of the well, such as, for example, the direction of the well, the mechanical stresses exerted on certain parts, the temperature, the pressure, etc. . . .

In the present text the terms connector and connection correspond, unless otherwise stated, respectively to the terms of electric connector and electric connection.

2. Description of the Prior Art

The prior art devices generally have drawbacks such as the necessity of machining the pipe elements, the mechanical fragility of the pipe element end connectors, the precarious electric insulation of the terminal or intermediate contacts, the wear of non interchangeable parts, dismantling difficulties, problems of fitting and manufacturing costs. Another serious drawback of prior art devices which may be illustrated by the patents EP-A-99805 and EP-A-274933 is to cause a modification of the pipe or a risk of damage to this pipe element.

These drawbacks are overcome, or at least very substantially attenuated by using the device according to the invention.

SUMMARY OF THE INVENTION

The assembly according to the invention avoids damaging the pipe element. Thus, in the case of application to the drilling field, the present invention neither modifies nor damages the drill string which it equips. The use of the present invention respects the integrity of the drill string elements and, in particular, respects the integrity of the resin layers with which the inner walls of these elements are coated. In addition, the device and method according to the present invention do not modify the conventional methods of renovating such elements. Finally, use of the device according to the invention is simple and optimizes the economic costs.

The basic idea of the present invention for forming at least one electric connection through several elements forming the pipe resides particularly in the fact that an anchorage piece is fixed inside a pipe element using an uncured gum or stabilizable material. During the curing or stabilizing operation, this uncured gum adheres and provides cohesion between the anchorage piece and the inner walls of the pipe element.

This uncured gum is placed in a housing formed in the anchorage piece.

The electric connection between an insulated conductor equipping the pipe element and the electric connector may be made by an electric connection such as an electrically insulated splice. Finally, the anchorage piece as well as the electric conductor providing the electric continuity through the pipe element may be fixed in the pipe element in a single operation.

Thus, the present invention relates to an assembly for forming at least one electric connection through a pipe formed of elements fixed together, each element having a first end and a second end, adapted to cooperate mechanically with the complementary ends of adjacent elements. This assembly comprises in combination for each pipe element:

a conductor placed inside said element, a first connector fixed to the first end of said pipe element and which cooperates electrically with said conductor, a second connector fixed to the second end of said pipe element and which cooperates electrically with said conductor, According to the invention at least one of said connectors comprises an anchorage piece and a removable connector, in addition the anchorage piece comprises a housing for receiving a charge of uncured gum or stabilizable material for fixing said anchorage piece on said pipe element after curing or stabilization, and finally the assembly according to the invention comprises means for locking the removable connector on the anchorage piece.

Without departing from the scope of the present invention, the two connectors of a pipe element may each comprise an anchorage piece and a removable connector, each of the anchorage pieces may comprise a housing for receiving a charge of uncured gum or stabilizable material and it may comprise means for locking each of the removable connectors on the corresponding anchorage piece.

The removable electric connector(s) may comprise a housing for receiving the electric conductor surplus created following drawing together and assembly of the removable connector and the anchorage piece.

At least one anchorage piece may comprise a rigid frame possibly made from perforated metal sheet and an elastomer body stabilized prior to curing or stabilization of said uncured gum or stabilizable material.

This housing for receiving a charge of uncured gum or stabilizable material is partially defined by said rigid frame.

At least one of the removable electric connectors may comprise at least one electricity collecting ring, said ring being fixed to said removable connector via a synthetic resin.

At least one removable electric connector may comprise a rigid support frame such as a metal sheet which may be perforated.

The electric conductor may be fixed inside said pipe element by means of a support such as a straight flexible or rigid strip.

The electric conductor may comprise its own insulation and an external flexible or rigid sheath. This external sheath may be made from an insulating material or not. The conductor equipped or not with its own insulation may be free in said external sheath.

This strip may be fixed to the pipe element by means of an uncured gum.

Curing of the charge of uncured gum and of the gum for fixing the strip may take place in a single operation.

The electric connection between the portion of the conductor equipping the pipe element over its usual length and the conductor portion equipping the removable connector may be achieved by splicing.

BRIEF DESCRIPTION OF THE DRAWINGS

Other aims and advantages of the present invention will be clear from the following description of an example more particularly applied to drill strings, given by way of non limitative illustration with reference to the accompanying drawings in which.

DESCRIPTION OF THE PREFERRED EMBODIMENT

In order to facilitate understanding of the simplified example which follows, the type of the different connectors has been fixed. Thus, the first connector is a male connector and the second connector is a female connector. The number of electric connections through the drill string has been limited to a single one. Finally, a pipe element comprises two removable connectors placed respectively at the ends of the pipe element. Of course, without departing from the scope of the present invention a pipe element may be equipped with a fixed connector and a removable connector, this latter comprising the electric contact part(s) which wear out the most quickly.

Figure 1:
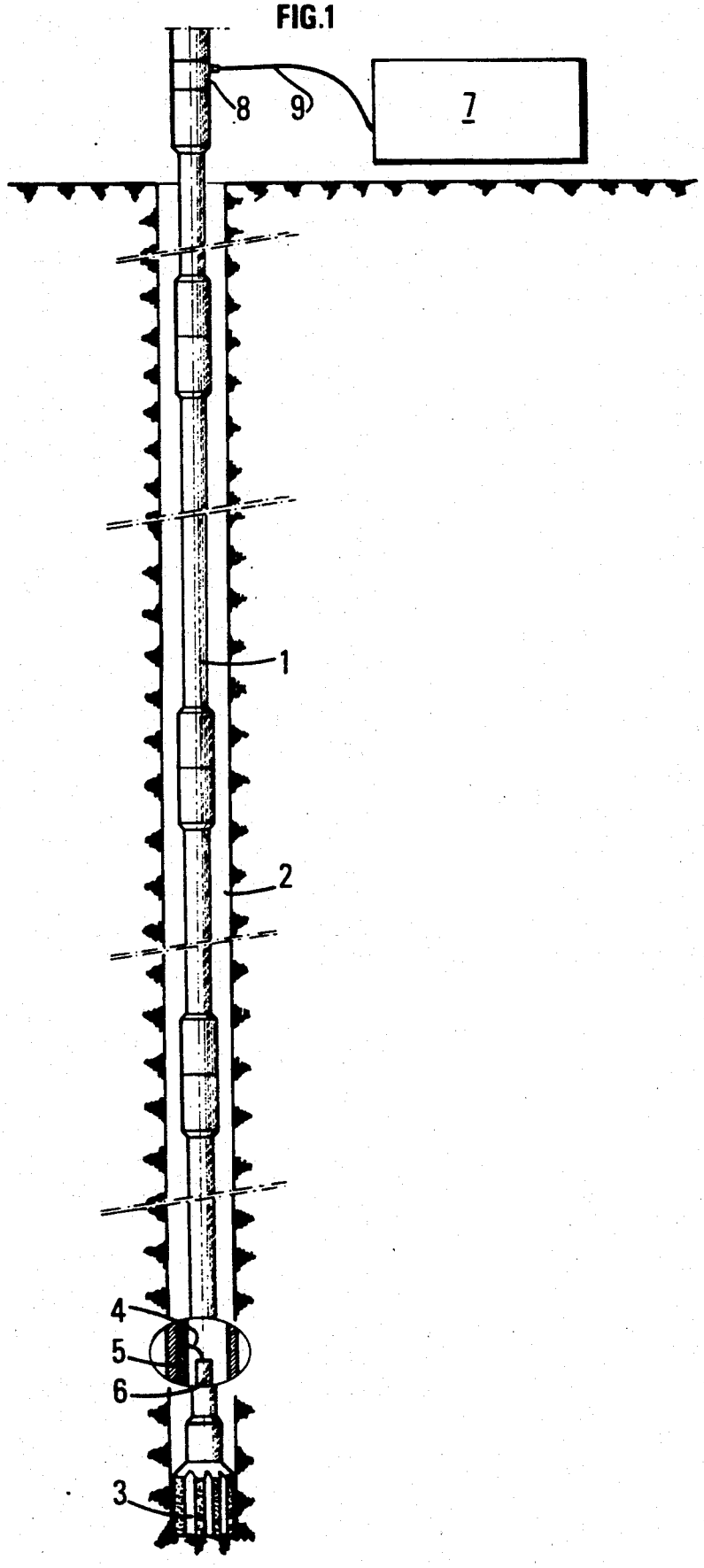
FIG. 1 shows schematically a drill string equipped with an electric connection.

FIG. 1 illustrates an embodiment according to the invention applied to a drill string 1. The well is designated by the reference 2. Reference 3 designates a drilling tool which may be replaced by any tool, or by a measuring probe. The junction between the different elements forming the drill string has not been shown.

It is of course possible in some cases to use the drill string, or even the earth or mud as electricity conducting medium. This makes it possible to form an electric circuit using only a single insulated electric conductor in the support. This is moreover the case of a single conductor which will be described in detail hereafter, but the invention is also applicable to the case of several conductors.

In the case of FIG. 1, the electric conductor 4 is embedded in the mass of a support 5 inside the pipe. The electric conductor 4 may comprise its own insulation, particularly if support 5 is not sufficiently electrically insulating. It may comprise a flexible or rigid external sheath 59, made from a material which is insulating or not, and the conductor equipped or not with its own insulation is free in said tubular sheath. In addition, the support serves as protective sheath for the insulated conductor.

In the embodiment described, the support is in the form of a strip disposed inside the pipe element along a generatrix.

In the case illustrated in FIG. 1, conductor 4 connects an apparatus 6 to a surface installation 7, these two assemblies cooperating electrically with each other. It is possible to use this assembly for providing an electric connection, even when the drill string is rotating. For this, it is necessary to provide at least one rotary contact. This may be formed, for example, by a ring 8 cooperating electrically with a contact 9. Since such devices are known in the prior art, it will not be described in detail here.

Figure 2:
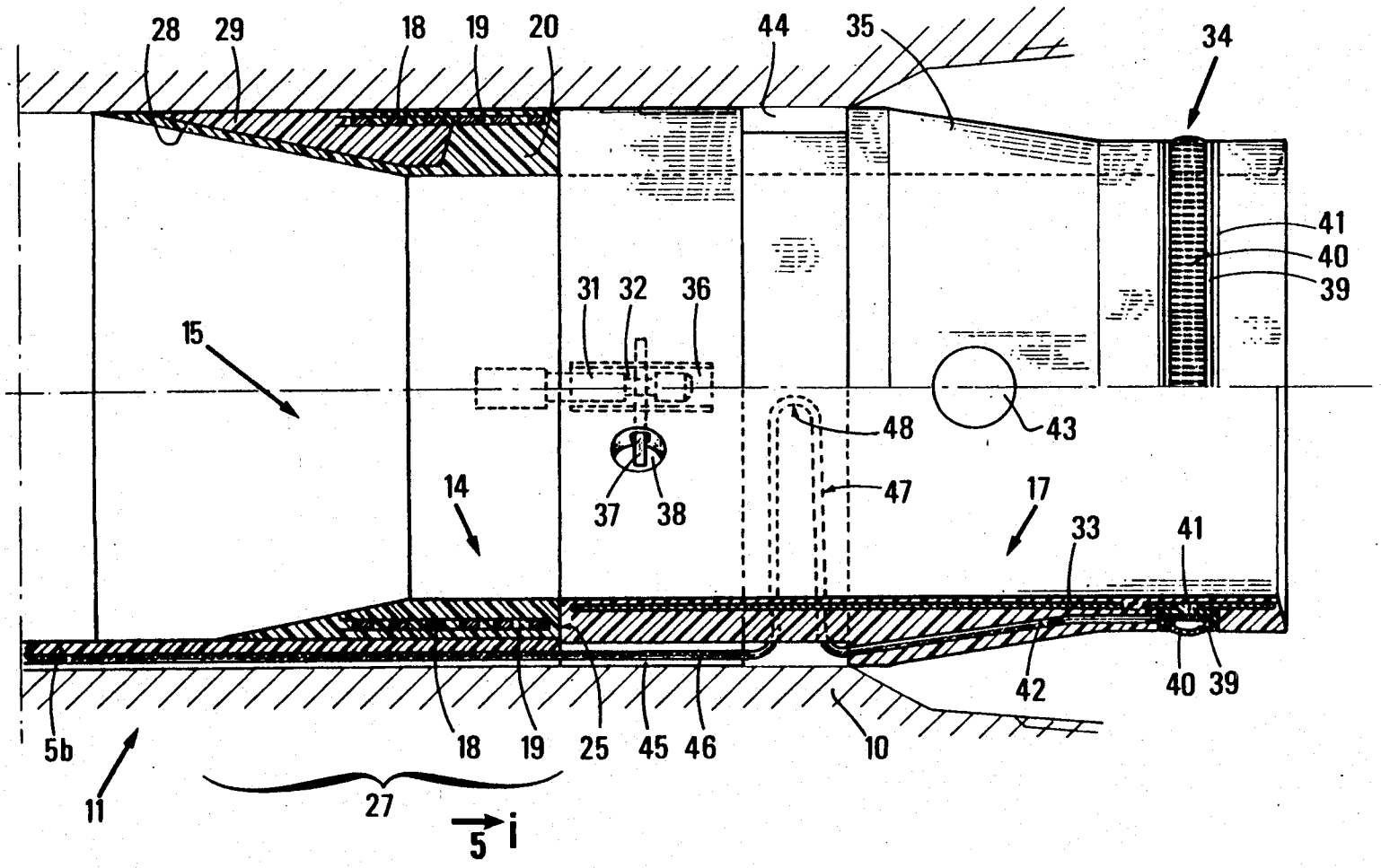
FIGS. 2 and 3 show respectively a male and female electric connector according to the invention.
Figure 3:
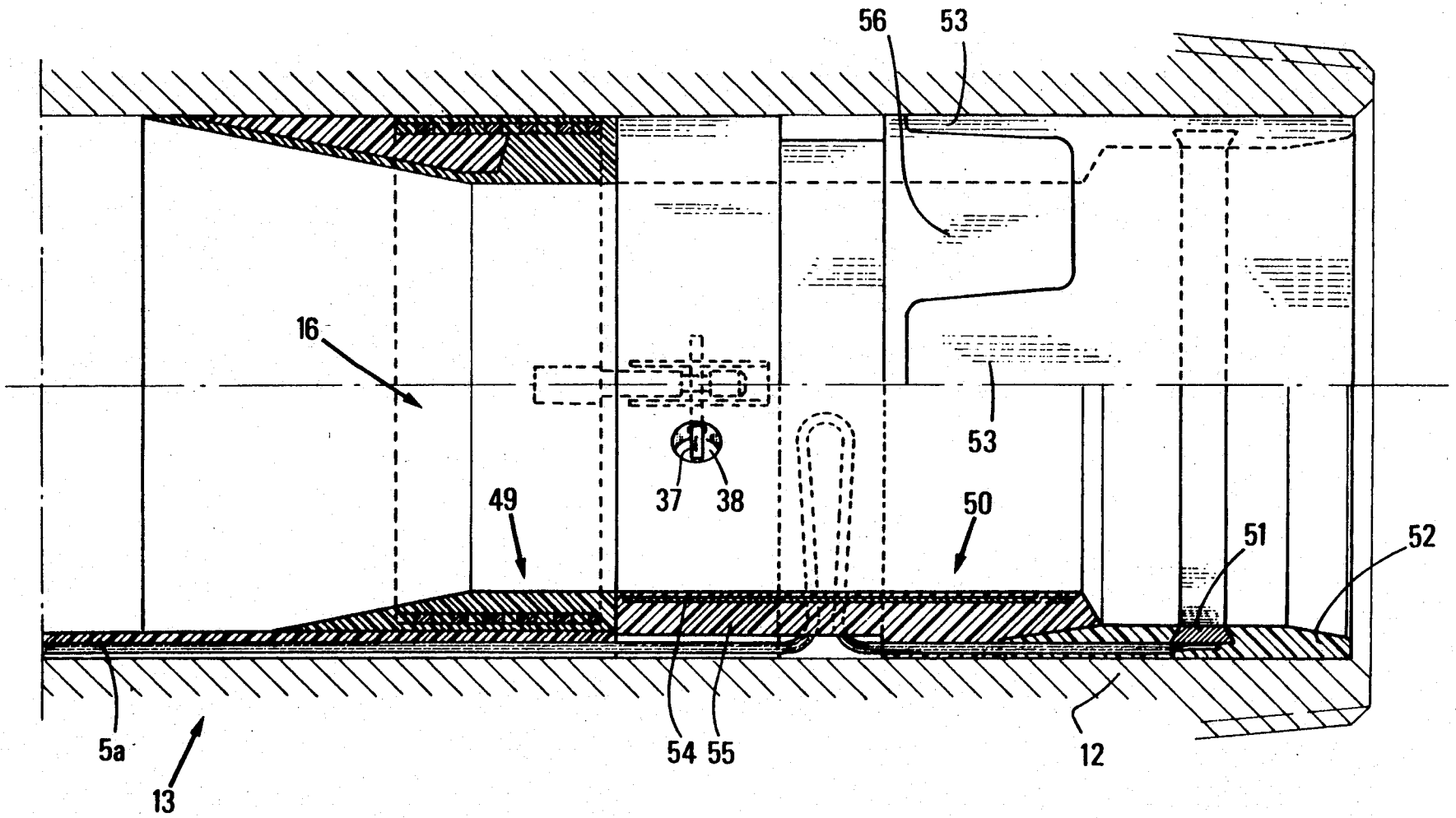

FIG. 2 shows the end 10 of a pipe element generally designed by the reference numeral 11 equipped with a male electric connector generally designated by the reference numeral 15. This end 10 may be connected mechanically to the end 12 of the adjacent element generally designated by the reference numeral FIG. 13 of the pipe shown in FIG. 3. This end 12 comprises a female electric connector generally designated by the reference numeral 16. Each of these elements 11 and 13 is equipped with a conductor for the electric connection. In FIGS. 2 and 3, the two pipe elements are threaded together. The invention is applicable to any type of threaded or other connection, as long as the connection of the different elements together uses at least one axial movement.

The male end 12 of a pipe element 13 is threaded into the female end 10 of the adjacent pipe element 11. References **5*a* and 5*b* designate respectively a support containing the electric conductor on the male side 12 of a pipe element 13 and on the female side 10 of the adjacent element 11**.

Thus, the male end 12 of the pipe element 13 comprises the female connector 16 and the female end 10 of the pipe element 11 comprises the male connector 15.

Figure 4:
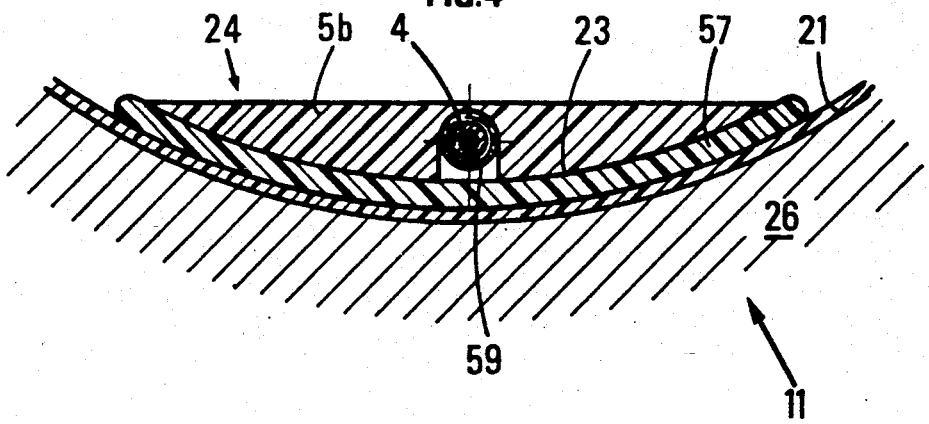
FIG. 4 shows a detail of fixing a conductor to a pipe element by means of a support.

FIG. 4 shows a cross sectional view of an element 11 of the drill string at the level of its usual length, i.e. outside the mechanical and electric connections, with reference numeral designating 26 the string element body.

The inner wall of a string element is generally covered with a reinforcement coating 21 generally made from epoxy resin and designated "Kote coating", which is a registered trademark, by specialists. The present invention makes it possible to position the electric connection without damaging the Kote coating.

In FIG. 4, support **5*b* which contains the insulated electric conductor 4 with an external sheath 59, either embedded or placed in a groove of the support, comprises an osculatory or convex surface 23 cooperating with the internal surface of the pipe for holding the support and the conductor in position in the pipe, and comprises a curved or concave surface generally designated by the reference numeral 24** partially defining the new contours of the flow section of the pipe element comprising the support. The convex and concave surfaces are said to be complementary with each other not because they are in contact with each other but because they belong to the same element.

The plane curved surface 24 such as shown in FIG. 4 offers the advantage of not having any protuberance whose existence in the presence, in particular, of the transfer of materials rotating inside the pipe would facilitate damage to the support and stripping thereof from the pipe and not reducing too much the flow section of the pipe.

The male connector 15 comprises an anchorage piece generally designated by the reference numeral 14 and a removable connector generally designated by the reference numeral 17 of male type.

The anchorage piece 14 comprises a rigid frame or reinforcement 18, possibly made from metal, with perforations 19 for enhancing the anchorage. This frame is embedded partially in a body 20 which may be made from a flexible material such as a stabilized elastomer or a stabilized gum.

The anchorage piece 14 has a shape complementary to that of the pipe end in which it is housed. Thus, when the pipe element has a cylindrical internal shape the anchorage piece 14 has a complementary shape.

Figure 5:
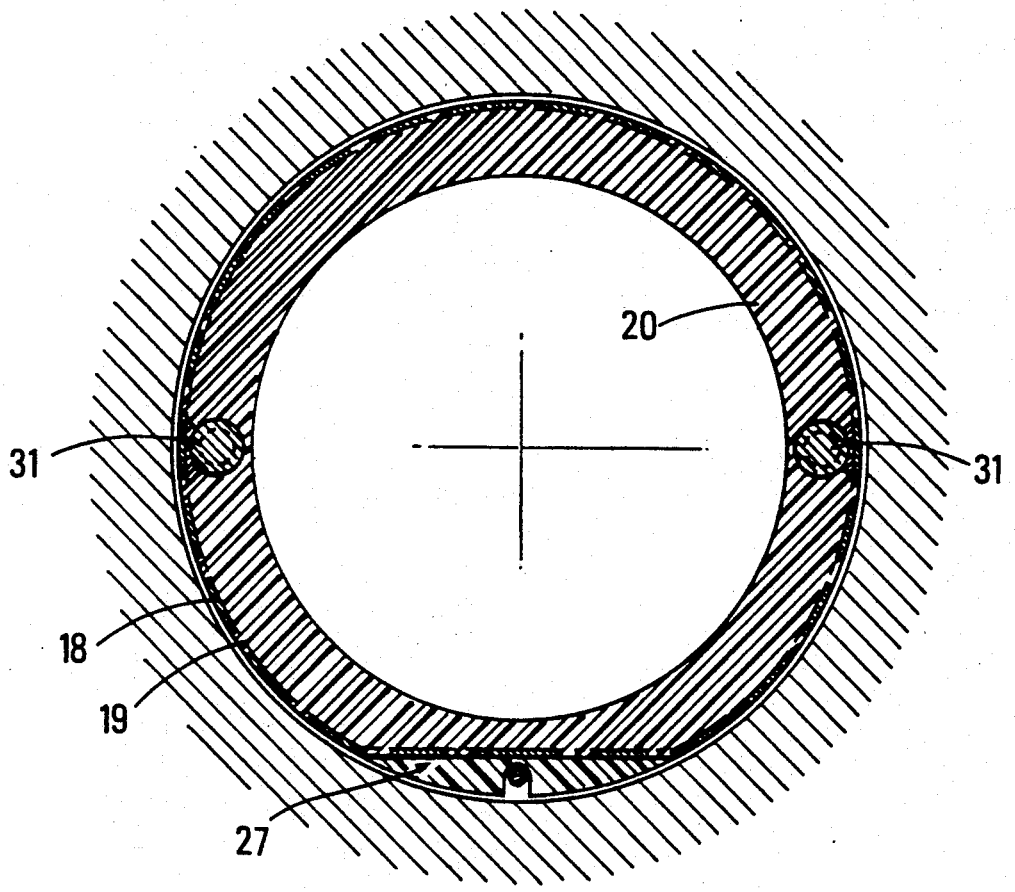
FIG. 5 is a cross-sectional view taken along the line V—V in FIG. 2.

In the case of the embodiment shown in the drawings, support 5*b* is in the form of a strip (FIG. 4) and is extended to the level of the face 25 (FIG. 2) of the anchorage piece 14 so that body 20 of the anchorage piece 14 and the rigid reinforcement have an overall cylindrical shape but with a flattened portion in the zone generally designated by the reference numeral 27 (FIG. 5). The body 20 of the anchorage piece 14 has a shape forming a substantially annular pocket 28 (FIG. 2) for receiving a preformed charge of uncured gum 29 which, after curing, will fix the anchorage piece 14 on the end 10 of the pipe element.

Reinforcement 18 projects partially from body 20 so that a portion 30 of the reinforcement 18 projects and is in contact with the uncured gum 29. Thus, at the time of curing the uncured gum, it will penetrate into the perforations 19 to provide better fixing of the anchorage piece 14 on the end 10.

When support 5*b* and the anchorage piece 14 are in position, possibly before bonding of this support 5*b*, a certain length 46 of conductor 4 projects from this assembly. This length must be equipped with an electric insulation, at least if the end 10 of the pipe element is electrically conducting.

The substantially annular compartment, housing or pocket 28 receiving the uncured gum 29 is defined by body 20 of the anchorage piece 14, by a portion of the internal wall of the pipe element and by support 5*b*.

Thus, the preformed uncured gum has a partially annular shape since it is interrupted at the level of support 5*b*.

In FIG. 2, pocket 28 has the complementary shape of a truncated cone surrounded by a cylinder.

Figure 6:
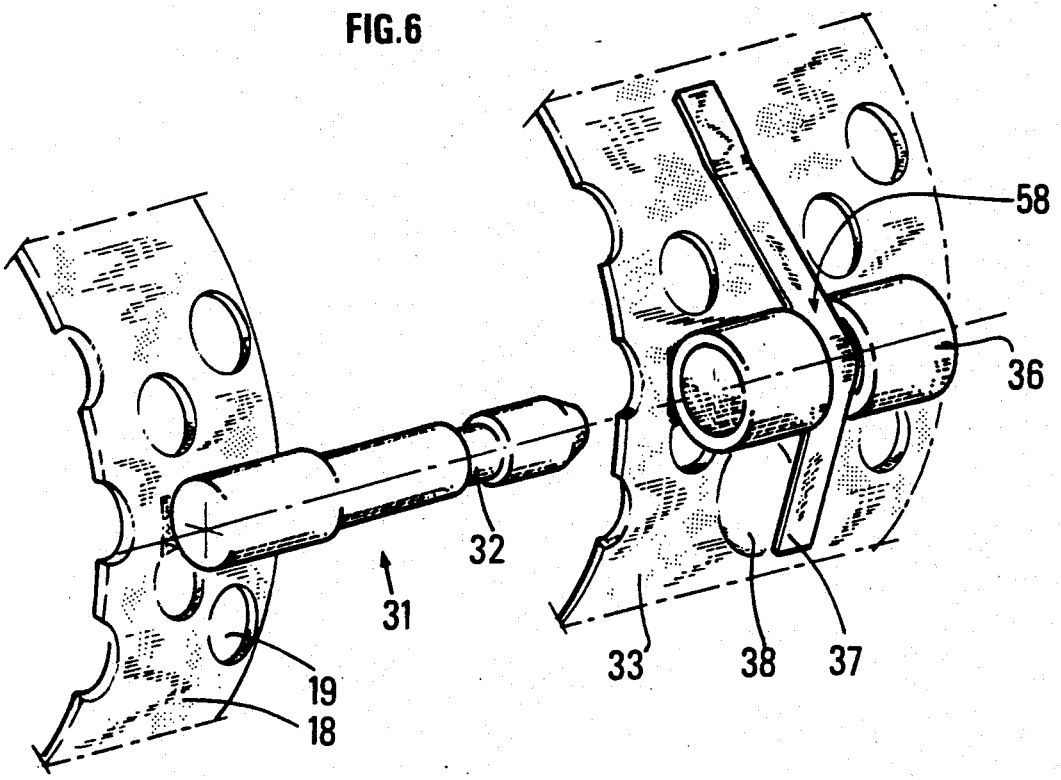
FIG. 6 shows in an exploded view a particular embodiment of the means for locking a removable electric connector or locking piece.

The rigid reinforcement 18 comprises two diametrically opposite pins generally designated by the reference numeral 31, these pins comprising a groove 32 (FIG. 6).

These pins 31 will serve for positioning and interlocking the removable male connector 17.

The removable male connector 17 comprises a rigid support frame 33 which may be made from perforated metal sheet, a flexible collector ring generally designated by the reference numeral 34 and a body 35 FIG. 2.

The rigid support frame 33 has two diametrically opposite welded housings 36 which cooperate with the interlocking pins 31. In addition, the rigid support frame 33 comprises a resilient finger 37 which cooperates through an opening 38 formed in the housing 36 with groove 32 for locking the connector 15 on the anchorage piece 14.

To unlock, the resilient fingers 37 are pushed back with an appropriate means from the orifices 38.

The collector ring 34 may comprise a conducting annular housing 39 in which is fixed a resilient collector ring 40, possibly crimped in the annular conducting housing 39. In a variant, the annular housing 39 may be in the form of a dovetail for holding a resilient collector ring in position, this latter being positioned from a zone of the annular conducting housing provided for this purpose.

The annular housing 39 may be fixed to the rigid support frame 33 by an epoxy resin 41, which may be achieved by a first molding. Of course, such molding must accommodate an electric conductor 42. The body 35 of the removable male connector may be made from elastomer or an equivalent material by a second molding.

This body 35 may comprise two diametrically opposite orifices, disposed transversely with respect to the walls of the removable male connector. The purpose of these orifices is to balance the pressures on each side of these walls. Such balancing promotes the electric contact and sealing.

The removable male connector comprises an annular groove 44 for housing the electric conductor surplus created by drawing the removable male connector 17 close to the corresponding anchorage piece 14.

A groove 45, which may be axial, accommodates the insulated conducting wire 46 so that it may reach the annular housing 44.

The electric conductors 46 and 42 are connected electrically by a splice generally designated by the reference numeral 47 formed when the removable male connector 17 is not in position and is distant from the anchorage piece 14.

At the time of positioning the male connector 17, the loop 48 of the electric conductor is pulled as the male connector 17 is brought gradually closer to the anchorage piece 14.

The female connector 16 comprises an anchorage piece generally designated by the reference numeral 49 and a removable female connector generally designated by the reference numeral 50 FIG. 3.

The anchorage piece 49 is identical to the anchorage piece 14 and will not be described.

The removable female connector 50 is substantially identical to the removable male connector 17 as to the pin fixing system, the axial groove for passage of the electric conductor as well as for the annular groove receiving the electric conductor surplus when the removable female connector and the anchorage piece 49 are brought together.

These common elements will therefore not be described.

As shown in FIG. 3, removable female connector 50 comprises a rigid collector ring 51 embedded in an epoxy resin molding 52. The shape of this molded epoxy part comprises indentations 53 extending axially. The removable female connector 50 further comprises a rigid support frame 54 on which are fixed the means for locking the removable female connector 50 with the anchorage piece 49.

The rigid support frame is embedded in an elastomer body 55 which provides cohesion of the molded epoxy part 52 on the rest of the removable female connector 50, i.e. the rigid frame 54.

The elastomer 55 comprises axial indentations 56 which cooperate with the indentations 53.

These indentations efficiently absorb the twisting torques which appear during assembly of two pipe elements by threading.

For positioning the support, supports 5 may be used made from a material which is not yet stabilized, partially stabilized, wholly stabilized or comprising portions stabilized differently.

Thus, as will be described hereafter in the preferred method of positioning the parts inside a pipe, the support containing the conductor is made from a sufficiently (even fully) stabilized material so as not to be unfortunately deformed under the action of expansion means and may be covered on its convex surface with a material, but uncured 57 (FIG. 4), for locking the support 5*b* with the portion of the pipe element 11 or more exactly on the epoxy coating or "Kote coating" 21.

In the preferred method of positioning the support 5*b*, sheath 59 will be housed in the support before positioning and conductor 4 will be replaced by a wire, for example, made from steel, with an external diameter at least equal to the external diameter of the insulated conductor 4. This wire will play the role of a needle which will be used, after the supports 5*a* or 5*b* and the anchorage pieces 49 and 15 have been fixed, for sliding the insulated conductor 4 in sheath 59 over the whole length of the assembly.

With the insulated conductor 4 free in sheath 59, if required it may be removed by pulling on one of its ends while pulling through another conductor fixed to the other end. If the conductor is no longer continuous from one end to the other, a sufficiently rigid needle will be pushed through sheath 59. Then the procedure is as before for housing another conductor in sheath 59 fixed in the pipe by support 5.

The apparatus for positioning support 5*a* or 5*b* and the anchorage pieces respectively 49 and 14 may comprise an extendible casing resting in a retracted position on a rigid tube having orifices pierced opposite the portions of the casing to be expanded. The casing and the tube form a closed volume having an opening connected to expansion means comprising a pressurized fluid generator adapted for inflating the casing so as to be able to position the support on the portion of the inner surface of the pipe. The concave surface of the support may advantageously be positioned and held in position on the external surface of the casing before this latter is inflated, but the support or any other part may be previously placed in the pipe or any hollow shape, before the casing holds them.

The convex surface of the support may be covered with a mastic, a bonding agent or an uncured elastomer for adhering the support to the portion of the inner surface of the pipe.

It is also possible to use, for example, a thermoplastic or thermo-hardening material adapted for producing the same effects.

For adhering the piece to the pipe part, an appropriate priming coat may be deposited thereon.

For some drill pipe elements already coated with a resin, such as "Tube-Kote coating" which is a trademark registered by the firm AMF Tuboscope, an appropriate adhesive material such as a gum may be chosen for preserving this coating.

In the preferred embodiment, the adhesive material is an uncured elastomer of the same type as that used for the support. This elastomer, placed on the convex surface of the support, is cured by the fluid for expanding the casing, which is in this case steam.

In the present invention, the uncured gum 29 for fixing the anchorage pieces on the pipe element is cured in a single operation at the same time as the support 5*b* is cured and using the same apparatus.

During positioning of the anchorage pieces they are positioned with respect to the reference faces of the pipe element so that once the connectors have been positioned and the pipe elements assembled together, the rigid 51 and resilient 34 electric rings are in contact.

Positioning of the electric conductor surplus in groove 44 may be achieved by pulling on the loop 48 of the surplus conductor by means of the small diameter wire which may be slid in the clearance between the pipe element and the removable male respectively female connector. Of course, this clearance is insufficient to allow the electric conductor surplus to pass which is then trapped in the annular groove 44.

What is claimed is:

1. An assembly for forming at least one electric connection through a pipe formed of pipe elements fixed together, each pipe element having a first end and a second end, adapted to cooperate mechanically with complementary ends of adjacent pipe elements, said assembly comprising for each pipe element:

an electric conductor placed inside said element, a first connector fixed to the first end of said pipe element and which cooperates electrically with said electric conductor, a second connector fixed to the second end of said pipe element and which cooperates electrically with said electric conductor, wherein said first and second connectors each comprises an anchorage piece and a removable connector, each of the anchorage pieces comprises a housing for receiving a charge of uncured gum or stabilizable material, and a rigid frame such as a metal sheet embedded in said anchorage pieces, wherein the assembly further includes means for locking each of the removable connectors on the corresponding anchorage piece, and wherein the electric conductor cooperates directly with the removable connectors.

2. The assembly as claimed in claim 1, wherein each removable connector comprises a housing for receiving a surplus amount of the conductor following assembly of the removable connector and associated anchorage piece together.

3. The assembly as claimed in claim 2, wherein said housing for receiving a charge of uncured gum or stabilizable material is partially defined by said rigid frame.

4. The assembly as claimed in claim 1, wherein at least one of the removable connectors comprises at least one electrical collector ring, said ring being fixed to said removable connector by a synthetic resin.

5. An assembly for forming at least one electric connection through a pipe formed of pipe elements fixed together, each pipe element having a first end and a second end, adapted to cooperate mechanically with complementary ends of adjacent pipe elements, said assembly comprising for each pipe element:

an electric conductor placed inside said element, a first connector fixed to the first end of said pipe element and which cooperates electrically with said electric conductor, a second connector fixed to the second end of said pipe element and which cooperates electrically with said electric conductor, wherein at least one of said connectors comprises an anchorage piece and a removable connector, said anchorage piece comprises a housing for receiving a charge of uncured gum or stabilizable material for fixing said anchorage piece on said pipe element after curing or stabilization, wherein the assembly comprises means for locking said removable connector on said anchorage piece, and wherein said at least one removable electric connector comprises a rigid support frame such as a metal sheet embedded in said removable electrical connector.

6. The assembly as claimed in one of claims 1, 2, 3, 4 or 5, wherein said electric conductor is fixed inside said pipe element by a straight flexible support strip.

7. The assembly as claimed in claim 6, wherein said electric conductor comprises an external flexible sheath, and wherein said conductor is freely disposed in said sheath.

8. The assembly as claimed in claim 6, wherein said strip is fixed by an uncured gum.

9. The assembly as claimed in claim 8, wherein curing of said charge of uncured gum and of said uncured gum for fixing said strip is carried out in a single operation.

10. The assembly as claimed in one of claims 1, 2, 3, 4 or 5, wherein an electric connection between a portion of said conductor of said pipe element and a conductor portion of said removable connector is achieved by splicing.

11. An assembly for forming at least one electric connection through a pipe formed of pipe elements fixed together, each pipe element having a first end and a second end, adapted to cooperate mechanically with complementary ends of adjacent pipe elements, said assembly comprising for each pipe element:

an electric conductor placed inside said element, a first connector fixed to the first end of said pipe element and which cooperates electrically with said electric conductor, a second connector fixed to the second end of said pipe element and which cooperates electrically with said electric conductor, wherein at least one of said connectors comprises an anchorage piece and a removable electric connector, said anchorage piece comprises a housing for receiving a charge of uncured gum or stabilizable material for fixing said anchorage piece on said pipe element after curing or stabilization, wherein said assembly further comprises means for locking said removable connector on said anchorage piece, wherein said at least one anchorage piece comprises a rigid frame, and wherein said rigid frame is formed from a perforated metal sheet embedded in an elastomer body stabilized prior to curing or stabilization of said uncured gum or stabilizable material.

12. The assembly as claimed in one of claims 1, 2, 3, 4 or 5, wherein said electric conductor is fixed inside said pipe element by a rigid strip.

13. The assembly as claimed in claim 12, wherein said electric conductor comprises an external rigid sheath, and wherein said conductor is freely disposed in said sheath.

14. The assembly as claimed in claim 12, wherein said strip is fixed by an uncured gum.

15. The assembly as claimed in claim 14, wherein curing of said charge of uncured gum and of said uncured gum for fixing said strip is carried out in a single operation.

16. The assembly as claimed in claim 5, wherein said metal sheet is perforated.

* * * * *